United States Patent [19]

Carver et al.

[11] Patent Number: 4,803,733

[45] Date of Patent: Feb. 7, 1989

[54] LOUDSPEAKER DIAPHRAGM MOUNTING SYSTEM AND METHOD

[76] Inventors: Robert W. Carver, 330 Ave. "A", Snohomish, Wash. 98290; James J. Croft, 911 N. 68th St., Seattle, Wash. 98103

[21] Appl. No.: 942,879

[22] Filed: Dec. 16, 1986

[51] Int. Cl.[4] ..... H04R 9/06; H04R 7/02; H04R 7/20; H04R 31/00

[52] U.S. Cl. ..... 381/193; 29/594; 181/172; 381/196; 381/199; 381/203

[58] Field of Search ..... 381/205, 202, 203, 199, 381/192, 193, 194, 196; 181/172; 29/594

[56] References Cited

U.S. PATENT DOCUMENTS

| | | | |
|---|---|---|---|
| 3,141,071 | 7/1964 | Rich | 381/199 |
| 3,674,946 | 7/1972 | Winey | 381/196 |
| 3,829,623 | 8/1974 | Willis et al. | 381/196 |
| 3,898,598 | 8/1975 | Asashi | 381/196 |
| 3,919,499 | 11/1975 | Winey | 381/196 |
| 3,997,739 | 12/1976 | Kishikawa et al. | 381/196 |
| 4,156,801 | 5/1979 | Whelan et al. | 381/196 |
| 4,273,968 | 6/1981 | Suyama | 381/202 |
| 4,317,966 | 3/1982 | Lister | 381/202 |
| 4,319,096 | 3/1982 | Winey | 381/203 |
| 4,471,173 | 9/1984 | Winey | 381/203 |
| 4,550,228 | 10/1985 | Walker et al. | 381/203 |

*Primary Examiner*—Jin F. Ng
*Assistant Examiner*—Danita R. Byrd
*Attorney, Agent, or Firm*—Hughes, Cassidy & Multer

[57] ABSTRACT

A loudspeaker diaphragm mounting system where there is a perimeter frame to which is mounted a planar flexible diaphragm having electrically conductive elements thereon. The frame has two perimeter sections which have matching perimeter grooves to receive an elongate tensioning member which presses the edge portion of the diaphragm into at least one of the grooves. By controlling the force with which the two frame sections are pushed together, tension on the diaphragm can be controlled.

18 Claims, 2 Drawing Sheets

LOUDSPEAKER DIAPHRAGM MOUNTING SYSTEM AND METHOD

BACKGROUND OF THE INVENTION

1. Technical Field

The present invention relates to speakers to produce sound in response to an audio signal, and also to a method of manufacturing and utilizing the same.

2. Background Art

There are known in the prior art various types of speakers having a flexible planar diaphragm mounted by its edge portions in perimeter frame. Electrically conductive elements are mounted directly to the diaphragm (e.g. in the form of wires or one or more elongate foil strips), and an amplified audio signal is directed through the conductive element or elements. Permanent magnets are placed adjacent to the diaphragm and the conductive element(s) so as to create a magnetic field to interact with the field created by the magnetic element(s). This in turn causes the diaphragm and its magnetic element(s) to vibrate and thus produce the sound.

This type of speaker is sometimes in the form of a ribbon speaker, where the diaphragm is an elongate ribbon, possibly several feet in length and only a few inches wide. Such speakers are well adapted to reproduce sound in the mid or high frequencies. In these ribbon speakers, the magnets are generally provided in the form of elongate bars positioned on opposite sides of the diaphragm.

Normally, the diaphragm will be tensioned to a moderate extent so that it has a neutral position from which it can move forwardly and rearwardly. For the speaker to faithfully reproduce the sound, it is necessary that the ribbon be properly tensioned along substantially its entire sound producing area. Further, the arrangement of the conductive element(s) relative to the location of the magnets should be such as to optimize the performance of the speaker.

A search of the patent literature has disclosed a number of patents relating generally to this type of speaker utilizing a vibrating diaphragm with conductive elements thereon, these being the following.

U.S. Pat. No. 4,319,096—Winey shows a speaker where one or more ribbon-like conductive elements are positioned in an area directly between two magnets. In one embodiment (FIG. 7), two foil strips are mounted to a diaphragm material, while in other embodiments (FIGS. 5, 6 and 8), the conductive ribbon-like element(s) itself (i.e. without being mounted to a diaphragm) creates the sound.

A rather similar arrangement is shown in U.S. Pat. No. 4,317,966—Lister.

U.S. Pat. No. 4,156,801—Whelan et al. shows a speaker where there are three permanent magnets 7 and 8, and two aluminum strips 9 which are attached to a plastic diaphragm that is in turn mounted to an edge frame. There are provided two sets of baffles 12 and 13 and 11 and 14, which are positioned to dissipate the sound which is emitted from the edge portions of the diaphragm.

U.S. Pat. No. 3,997,739—Kishikawa et al. shows a speaker where a plurality of magnets are positioned on opposite sides of the diaphragm, with conductive strips mounted to the diaphragm. A foam material 9 is positioned adjacent the diaphragm to provide damping.

U.S. Pat. No. 3,919,499—Winey shows a loud speaker having a diaphragm on which a multiplicity of conductive wires are positioned in parallel relationship.

U.S. Pat. No. 3,898,598—Asahi shows a speaker having a diaphragm of a circular configuration. In FIG. 8, the diaphragm is tensioned by an annular ring 48 having an upstanding edge that engages the diaphragm so as to tension the same.

U.S. Pat. No. 3,829,623—Willus et al. and U.S. Pat. No. 3,674,946—Winey show arrangements somewhat similar U.S. Pat. No. 3,919,499.

U.S. Pat. No. 3,141,079—Rich illustrates a speaker where the diaphragm is mounted in a perimeter frame, and there is a wire connected to the frame and arranged in a generally rectangular pattern where the rectangles formed by the wires are positioned within one another.

Also generally representative of the types of speakers are U.S. Pat. No. 4,550,228—Walker et al. and U.S. Pat. No. 4,273,968—Suyama.

SUMMARY OF THE INVENTION

The present invention relates to a speaker apparatus, and also to a method of making and utilizing the same. There is a perimeter frame to which is mounted a planar flexible diaphragm having at least one electrically conductive element thereon. One of the problems commonly associated with such speakers is that of properly tensioning the diaphragm for a proper reproduction of sound. The present invention uniquely solves this problem.

The perimeter frame defines a middle sound producing area and further has an edge mounting portion which borders this sound producing area.

There is a planar flexible diaphragm having an edge section that is connected to the edge mounting portion of the perimeter frame. This diaphragm has a middle sound producing section with at least one electrically conductive element thereon, positioned in the sound producing area defined by the frame.

A magnet means is mounted to the frame and positioned to create a magnetic field in the sound producing area to interact with the conductive element to cause the sound producing portion of the diaphragm to move back and forth.

The edge mounting portion of the frame has a tensioning groove means extending along at least part of the edge mounting portion of the frame. This groove means receives therein a portion of the edge section of the diaphragm. There is an elongate tension member positioned at the tensioning groove means and extending along that portion of the edge section of the diaphragm to press that portion of the edge section of the diaphragm into the tensioning groove means and thus tension the diaphragm. The perimeter frame is arranged with pressing means to press the tensioning member at least partially into the tensioning groove means so as to obtain the desired tensioning over the sound producing section of the diaphragm.

In one embodiment, the tension member is made of a moderately yielding material which yieldingly urges the portion of the edge section of the diaphragm into the groove means. In another embodiment, the tension member is made of a more rigid material, and in a specific configuration shown herein, this tensioning member is fixedly connected to (and in this particular embodiment made integral with) a second frame member which engages a first frame member, with the first and second frame members making up the perimeter frame.

In the particular embodiments shown herein, the diaphragm has an elongate configuration with a lengthwise dimension. The tensioning groove means and the tensioning means extends along said lengthwise dimension along at least one side of the sound producing section of the diaphragm (and in the exemplary embodiments shown herein along both sides). In these exemplary embodiments, the frame comprises first and second edge frame members. The tensioning groove means is formed in the first edge frame member, while the second edge frame member provides the pressing means to engage the tensioning member. In one embodiment, the second edge frame member has positioning groove means to receive at least partly the tensioning member so as to locate the tensioning member relative to the tensioning groove means. In another embodiment the tensioning member is made as part of the second frame.

As another feature of the present invention, the first and second frame edge members are connected by adjustable fastening means along the lengthwise dimension of the edge members. Thus, tension at lengthwise locations along the edge members can be adjusted by means of said adjustable fastening means.

In the particular embodiments shown herein, there are a plurality of conducting elements or strips on the diaphragm positioned at spaced lateral locations. These are electrically connected in series in a manner that an electric current passing through said plurality of elements creates a relatively stronger magnetic field, in comparison with an arrangement where the current would be passed through the elements in parallel. This, along with the lateral spacing of the elements, enhances the operation of the speaker.

In the method of the present invention, the components are provided as described above. Initially, the diaphragm is placed on a planar surface, so that it lies smoothly on the planar surface. Then a bonding agent is applied to an outer peripheral portion of the first frame section, with the tensioning groove means being positioned inwardly of the location of the bonding agent. The first frame section is then placed against the diaphragm, with the bonding edge portion of the first frame adhereing to outer perimeter portions of the diaphragm.

Then, the second frame section is positioned against the first frame section, with the yielding tensioning member being positioned at the tensioning groove means, so that the second frame member presses the tension member moderately into the tensioning groove means.

In the preferred form, the elongate tensioning member is placed in locating groove means of the second frame member so as to be properly positioned therein.

After the two frame sections are positioned one against the other, the adjustable connecting means can be operated to apply proper force against the two frame sections so as to control the tension of the diaphragm within close limits.

Other features of the present invention will become apparent from the following detailed description.

DESCRIPTION OF THE PREFERRED EMBODIMENTS

Figure 1:
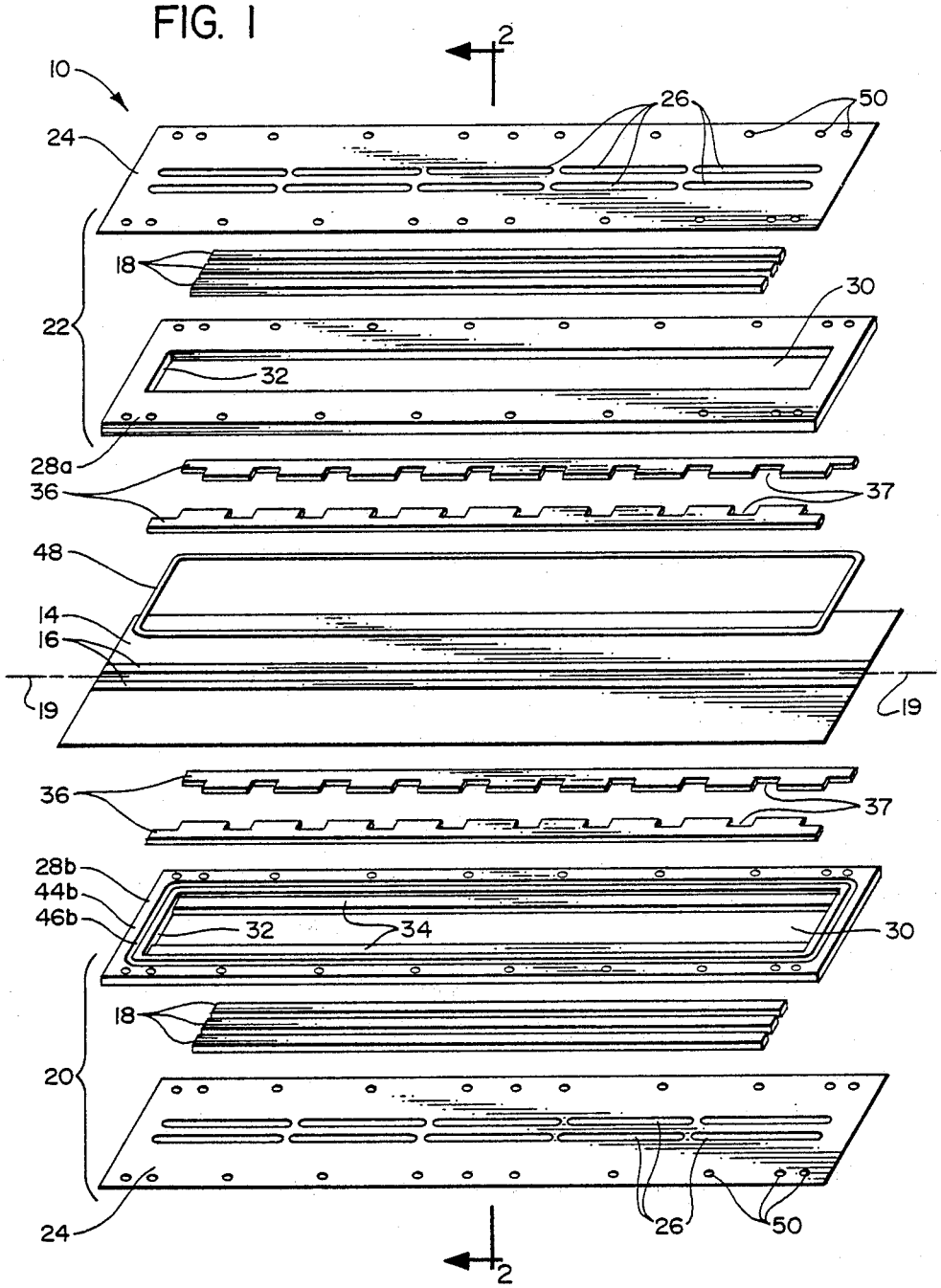
FIG. 1 is an isometric exploded view illustrating the components of a first embodiment of the present invention.
Figure 2:
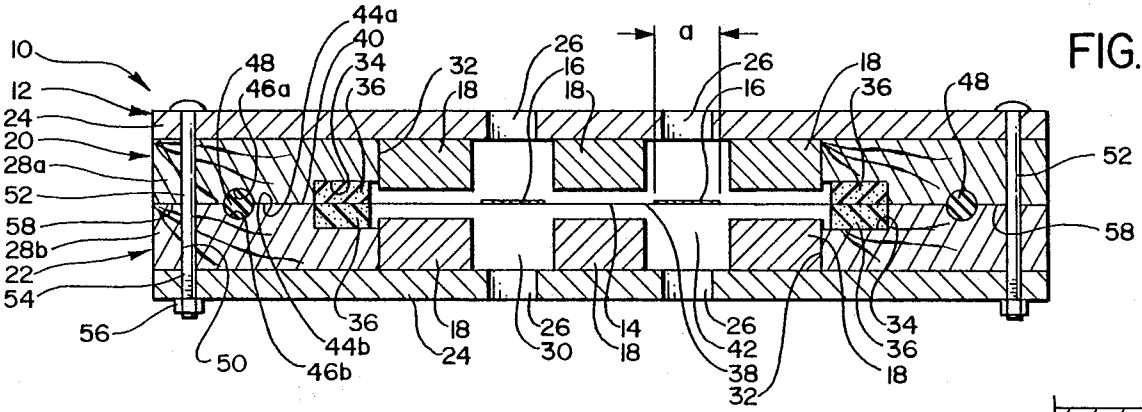
FIG. 2 is a sectional view taken through line 2—2 of FIG. 1, with the components being in the assembled position.

With reference to FIGS. 1 and 2, the speaker 10 of the first embodiment comprises a perimeter frame 12, a planar flexible diaphragm 14 having in this embodiment two conductive metallic strips 16 bonded thereto, and two sets of permanent magnets 18. Of particular significance in the present invention is the manner in which the diaphragm 14 is mounted to the perimeter frame 12, in a manner to provide proper tensioning of the diaphragm 14 within the perimeter frame. This will be described more particularly hereinafter. The speaker 10 has an overall elongate configuration, with the diaphragm 14 having a substantial lengthwise dimension and a relatively small width dimension. The conductive elements 16 extend along the lengthwise axis of the speaker, which in FIG. 2 is illustrated at 19. In the particular configuration shown herein, the speaker has an overall rectangular configuration. However, it is to be understood that the particular configuration could vary from this rectangle. Further, the speaker 10 can be incorporated with other speakers in a total speaker assembly.

The perimeter frame 12 comprises first and second perimeter frame sections 20 and 22. In this particular embodiment, the two frame sections 20 and 22 are made substantially identical to one another. Each frame section 20 or 22 comprises a base plate 24 having elongate slots 26 formed therein to allow for the passage of air therethrough.

Connected to each base plate 24 is a related edge frame member **28*a* or 28*b* having a rectangular opened middle area 30. For purposes of description, the frame member of the section 20 is designated 28*b* and the frame member of the second section 22 is designated 28*a*. More specifically, the inner edge portion of each frame member 28*a* or 28*b* has an inwardly facing surface 32 that defines the open area 30. Further, this inwardly facing surface 32 is provided at the elongate side portions of the members 28*a* or 28*b* with a recess 34 that in cross-section has a rectangular configuration. There is positioned in each recess 34 an elongate foam strip 36 having in cross-section a rectangular configuration. In FIG. 1, the four foam strips 36 are shown with rectangular cut-out portions 37. However, these cut-outs 37 are optional, and the foam strips 36 can be made of a uniform rectangular configuration. Thus, the overall cross-sectional configuration of the elongate side portions of each frame member 28*a* or 28*b* with the foam strip 36** mounted therein is that of a rectangle.

There are two sets of magnets 18, with three magnets 18 being in each set. Each magnet 18 has an elongate configuration, with one magnet set 18 being connected to the base plate 24 of the first frame member 20, and the other set of magnets 18 being connected to the base plate 24 of the other frame member 22. A center magnet 18 of each set is positioned between the slots 26 of its base plate 24, while the other two magnets 18 are positioned just outside of the slots 26.

With regard to the diaphragm 14, this is desirably made of a quite thin, flexible, substantially non-stretchable material. A material marketed under the trademark "Kapton" has been found to be quite suitable, and a 0.5 mil thickness has also been found to adequate. In this particular configuration, this diaphragm 14 also has a rectangular configuration.

The conductive elements 16 are made of 0.35 mil aluminum foil which is bonded to the Kapton. In this preferred embodiment, the width dimension (indicated at "a" in FIG. 2) is 0.32 inches, and the two strips or elements 16 are positioned about 0.40 inches apart from one another.

The diaphragm 14 can be considered as having a middle sound producing area 38 and a perimeter portion 40. The rectangular configuration and dimensions of the diaphragm 14 are substantially the same as those of the edge frame members 28*a* and 28*b*. Thus, in the assembled position, the perimeter portion 40 of the diaphragm 14 is positioned between the two edge frame members 28*a* and 28*b*, while the middle sound producing portion 38 is positioned in a sound producing area 42 defined by the edge frame members 28*a* and 28*b*.

It would be helpful at this point to review the overall operation of the speaker 10 incorporating the features of the present invention. The two sets of magnets 18 set up magnetic fields in the sound producing area 42. When current is passed through the conductive strips or elements 16, this causes an interaction with the magnetic field set up by the magnets 18 to cause the strips to move in the sound producing area 42. Thus, as the amplified audio signal passes through the strips or elements 16, the variations in the signal current cause the strips 16 to interact with the magnetic field to cause the diaphragm 14 to move back and forth. This produces the sound waves which travel outwardly through the slots 26.

To turn our attention now to the significant features of the present invention, the two edge frame members 28*a* and, 28*b* can be considered as having contact faces 44*a* and 44*b*, respectively with the two 44*a* and 44*b* faces 44 facing one another and engaging the perimeter portion 40 of the diaphragm 14.

Formed in the edge frame members 28 of the two perimeter frame members 20 and 22 are respective perimeter grooves 46*a* and 46*b*, respectively. These grooves 46*a* and 46*b* are positioned so that they face one another so as to collectively form a peripheral elongate recess which extends around the entire perimeter of the two edge frame members 28*a* and 28*b*.

There is also provided a moderately flexible elongate tensioning member which extends around the entire periphery of the two edge frame members 28 at the location of the grooves 46*a* and 46*b*. This tensioning member 48 has, in this particular configuration, a generally circular cross-sectional configuration, and it is made of a moderately yielding material.

To describe the function of this tensioning member 48, we shall consider the groove 46*b* to be a locating groove, and the tensioning member 48 is positioned in the groove 46*b*. The groove 46*a* can be considered as a tensioning groove, and the perimeter portion 40 of the diaphragm 14 is positioned between the tensioning member 48 and the groove 46*a*. Thus, the elongate tubular tensioning member 48*a*, being moderately compressible, tends to push the perimeter portion of the diaphragm 14 into the tensioning groove 46*a*, this in turn creating a tension force across the middle sound producing portion 38 of the diaphragm 14.

At regularly spaced locations around the perimeter of the two frame sections 20 and 22 are through openings 50 to receive therein adjustable fasteners 52. In the particular embodiment shown herein, these fasteners 52 are provided in the form of bolts 54 having nuts 56 connected to the threaded ends of the bolts 54. It can be readily understood that by threading the nuts further on to the bolts 54 the force exerted at any particular location to press the two frame sections 20 and 22 against one another can be varied. The frame members 28*a* and 28*b* are made of wood and thus will yield slightly under a compressive force. Thus, it becomes possible by use of the adjustable fastening members 52 to obtain precise adjustment of the tensioning of the diaphragm 14 around the periphery of the frame 12.

The method of assembling the speaker 10 of the present invention is accomplished as follows. First, there is provided a flat glass plate having a planar surface. The diaphragm 14 is aced on the surface of the glass plate, and it is smoothed out to remove any wrinkles. Next, an adhesive is applied as at 58, to the contact face 44*a* of the edge frame member 28*a* at a location outwardly of the tensioning groove 46*a*. This can simply be a strip of double-faced adhesive that is placed around the entire perimeter of the edge frame member 28*a*. Alternatively, some other adhesive could be used.

Then the first perimeter frame section 20 is carefully placed on top of the diaphragm 14 that is positioned on the glass surface so that the outer part of the perimeter portion 40 of the diaphragm 14 becomes bonded to the adhesive strip 58. Then, the first frame section 20 is turned over so that the diaphragm 14 is facing upwardly.

The elongate tensioning member 48 is placed in the locating groove 46*b* of the edge frame member 28*b* of the second frame section 22. Then the second frame section 22 is carefully placed against the first frame section 20 so that the elongate tensioning member 48 presses an adjacent part of the perimeter portion 40 of the diaphragm 14 into the tensioning groove 46*a* of the first perimeter frame section 20. Since the adhesive 58 holds the extreme outer perimeter portion of the diaphragm 14 stationary relative to the first frame section 20, the force exerted by the tensioning member 48 tending to push the perimeter diaphragm portion 40 into the tensioning groove 46*a* reacts in a manner to tension the middle sound producing portion 38 of the diaphragm 14. For purposes of illustration, in FIG. 2A the tensioning member 48 is shown uncompressed. However, it is to be understood that there will ordinarily be a certain amount of compression of the member 48, depending on the tensioning required.

Then the bolts 54 are placed through the appropriate openings 50, and the nuts 56 threaded thereon. The nuts 56 are threaded onto the bolts 54 to the extent necessary to provide the proper localized force to push the frame sections 20 and 22 against one another to create the proper tensioning across the diaphragm 14. Conventional quality control techniques can be used to determine the proper tensioning of the diaphragm 14, and the tightening and loosening of the nuts 56 can be utilized for fine adjustment.

With regard to the particular configuration of the grooves 46*a* and 46*b*, in the particular embodiment shown herein, these two grooves each have a circular configuration so as to define a 180° arc. However, it is to be understood that within the broader scope of the present invention, the particular cross-sectional configuration of these grooves 46*a* and 46*b* could be changed. Further, while the adjustable fastening members 52 have been shown as nut and bolt connections, other fastening devices could be used.

Figure 3:
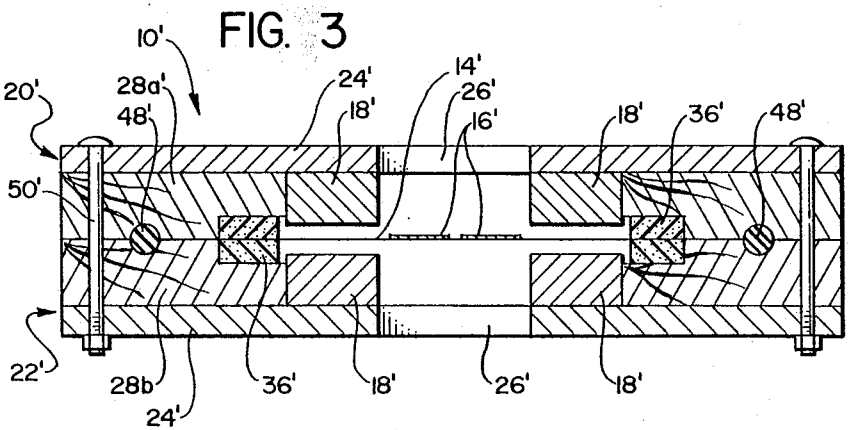
FIG. 3 is a sectional view similar to that of FIG. 2, and showing a second embodiment of the present invention.

A second embodiment of the present invention is shown in FIG. 3. Components of this second embodiment which are similar to components of the first embodiment will be given corresponding numerical designations, with a prime (') designation distinguishing those of the second embodiment.

The main difference in this second embodiment is that instead of having two sets of three magnets 18, there are two sets of only two magnets 18'. Thus, there is provided in the two plates 24' only one elongate slot 26' (or one elongate row of slots 26') rather than two rows of slots 26 as in the first embodiment. Also, the two conducting elements or strips 16' are positioned inwardly of the magnets 18'.

The other components of this second embodiment are substantially the same as in the first embodiment, and accordingly there will be no detailed description of these in connection of this second embodiment. Rather, some of these components will be simply identified by their appropriate numerical designation, with the prime (') suffix distinguishing these as being in the second embodiment It also has been found advantageous in the present invention to pass the audio signal through the elements or strips 16 in series rather than in parallel. By doing so, the effect of the current through the strips or elements 16' in creating a magnetic field to interact with the field created by the magnets 18' is intensified, as compared to the situation where there is a plurality of elements and the current is passed through in parallel. This intensified magnetic field, together with the fact that the two elements are spaced side by side and thus affect a greater area of the diaphragm 14', enhances the proper reproduction of the sound. In the particular embodiment of FIG. 3, the current is passed through the conductive elements or strips 16' in the same direction. Thus, it is necessary to make a connection from the bottom end of the first strip 16' to the top end of the second strip 16', thus causing the magnetic field created by the strips 16' to reinforce one another.

Figure 4:
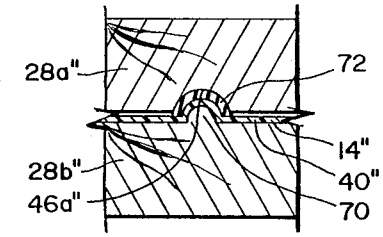
FIG. 4 is a sectional view similar to FIG. 2A and showing a third embodiment.

In FIG. 4, there is shown a third embodiment of the present invention. Components of this third embodiment which are similar to components of the prior two embodiments will be given like designations, with a double prime (") designation distinguishing those of this third embodiment.

Figure 2A:
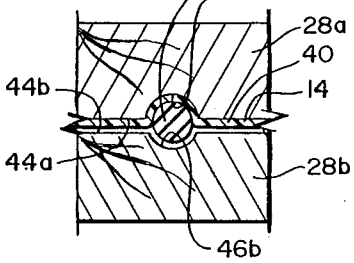
FIG. 2A is an enlarged view of the edge portion of the cross sectional view of FIG. 2.

FIG. 4 is a view similar to FIG. 2*a*, and the main difference in this third embodiment is that instead of having a moderately yielding tensioning member, as at 48 in the first embodiment, the tensioning member is provided as an integral part of the second frame section 28*b*". Thus, it can be seen that this second frame member 28*b*" has a perimeter bead 70 which extends around the perimeter of the second frame section 28*b*", with this bead 70 having in cross-section a semi-circular configuration. The groove 46*a*" is formed in the first frame section 28*a*" as in the prior embodiments.

As a refinement of the embodiment of FIG. 4, to provide a somewhat yielding force of the tensioning member 70, there may be inserted a gasket 72 around the perimeter of the frame sections 28*a*" and 28*b*", with this gasket 72 being positioned between these two members 28*a*" and 28*b*" to provide a small amount of yield as these two members 28*a*" and 28*b*" are pressed together. In other respects, the function of this third embodiment is substantially similar to the functioning of the prior two embodiments.

It is to be understood that various modifications could be made to the embodiments shown here without departing from the basic teachings of the present invention.

We claim:

1. A speaker apparatus comprising:

(a) A perimeter frame defining a middle sound producing area and having an edge mounting portion, (b) a planar flexible diaphragm having an edge section connected to the edge mounting portion of the frame and a middle sound producing section with at least one electrically conductive element thereon, positioned in the sound producing area defined by the frame, (c) a magnet means mounted to the frame and positioned to create a magnetic field in the sound producing area to interact with said conductive element to cause the sound producing portion of the diaphragm to move back and forth, (d) said edge mounting portion of the frame having a tensioning groove means extending along at least part of the edge mounting portion of the frame and receiving therein a portion of the edge section of the diaphragm (e) an elongate tensioning member positioned at said tensioning groove means and extending along said portion of the edge section of the diaphragm to press said portion of the edge section of the diaphragm into the tensioning groove means and thus tension the diaphragm, and (f) said perimeter frame being arranged with pressing means to press the elongate tensioning member at least partially into the tensioning groove means, to obtain a desired tensioning over the sound producing section of the diaphragm.

2. The apparatus as recited in claim 1, wherein said elongate tensioning member is made of a moderately yielding material to yieldingly press said portion of the edge section of the diaphragm into the tensioning groove means.

3. The apparatus as recited in claim 1, wherein said elongate tensioning member is made of a relatively rigid material mounted to a frame member to yieldingly press the elongate tensioning member at least partially into the tensioning groove means.

4. The apparatus as recited in claim 1, wherein said diaphragm has an elongate configuration with a lengthwise dimension, and said tensioning groove means and said tensioning means extends along said lengthwise dimension along at least one side of the sound producing section of the diaphragm.

5. The apparatus as recited in claim 4, wherein said tensioning groove means and said tensioning member extends along both sides of said sound producing section.

6. The apparatus as recited in claim 5, wherein said frame comprises first and second edge frame members, said tensioning groove means being formed in said first edge frame member, and said second edge frame member provides said pressing means to engage the tensioning member.

7. The apparatus as recited in claim 6, wherein said second edge frame member has positioning groove means to receive at least partly said tensioning member so as to locate said tensioning member relative to said tensioning groove means.

8. The apparatus as recited in claim 7, wherein said first and second frame edge members are connected by adjustable fastening means along a lengthwise dimension of said edge members, whereby tension at lengthwise locations along said edge members can be adjusted by means of said adjustable fastening means.

9. The apparatus as recited in claim 1, wherein said frame comprises first and second edge frame members, said tensioning groove means being formed in said first edge frame member, and said second edge frame member provides said pressing means to press the tensioning member at least partially into the tensioning groove means.

10. The apparatus as recited in claim 9, wherein said second edge frame member has positioning groove means to receive at least partly said tensioning member so as to locate said tensioning member relative to said tensioning groove means.

11. The apparatus as recited in claim 10, wherein said first and second frame edge members are connected by adjustable fastening means along a lengthwise dimension of said edge members, whereby tension at lengthwise locations along said edge members can be adjusted by means of said adjustable fastening means.

12. The apparatus as recited in claim 1, wherein said frame comprises first and second edge frame members, said tensioning groove means being formed in said first edge member, and said elongate tensioning member being connected to said second edge frame member with said: second edge frame member comprising said pressing means to press the tensioning member at least partially into the tensioning groove means.

13. The apparatus as recited in claim 12, wherein said tensioning member is fixedly connected to said second edge frame member.

14. The apparatus as recited in claim 13, wherein said first and second frame edge members are connected by adjustable fastening means along a lengthwise dimension of said edge members, whereby tension at lengthwise locations along said edge members can be adjusted by means of said adjustable fastening means.

15. The apparatus as recited in claim 1, wherein there is a plurality of elongate parallel electrically conductive elements on said diaphragm, said elements being electrically connected to one another in series, in a manner that an electric current passing through said elements in series creates magnetic fields around each element that reinforce one another to make a relatively stronger magnetic field to interact with the field of said magnet means.

16. A method of making a speaker apparatus, said method comprising:

(a) placing a planar flexible diaphragm onto a planar surface in a manner that said diaphragm is positioned smoothly on said planar surface, (b) providing a perimeter frame comprising first and second perimeter frame sections, said first section having an edge contact face, and having at an outer perimeter portion of said contact face an elongate adhesive portion, said first perimeter frame section also having at said contact face a tensioning groove means extending along at least part of an edge mounting portion of the first frame section, (c) placing said first frame section in contact with said diaphragm which is on said planar surface, in a manner that the adhesive edge portion comes into bonding contact with an outer perimeter portion of said diaphragm so that said diaphragm adheres to said first frame section, (d) priding said second perimeter frame section with a perimeter contact face, and further providing an elongate moderately yielding tensioning member to be positioned between said contact face of the second frame section and said diaphragm, and further positioning said elongate tensioning member at the tensioning groove means of the first frame section, (e) connecting said first and second frame sections to one another, in a manner that said second frame section presses said elongate tensioning member against a portion of the edge section of the diaphragm so as to push said portion of the edge section of the diaphragm at least partly into said groove means, so as to provide a tension force on a middle sound producing section of the diaphragm.

17. The method as recited in claim 16, wherein said first and second frame sections are interconnected by adjustable connecting means which can push said first and second frame sections together with a bearing force, said method further comprising adjusting said connecting means to exert greater or less force in a manner that tension on the middle sound producing section of the diaphragm can be provided within relatively close tolerances.

18. The method as recited in claim 16, further comprising providing said second frame member with a positioning groove at the contact face of the second frame member and positioning said elongate tensioning member in said positioning groove, after which said first and second frame sections are connected one to the other, with the positioning groove properly locating the tensioning member relative to the tensioning groove means.

* * * * *